US005829600A

United States Patent [19]

Jordan et al.

[11] Patent Number: 5,829,600

[45] Date of Patent: Nov. 3, 1998

[54] METHOD AND APPARATUS FOR IDENTIFYING DIFFERENT, ELONGATED METALLIC OBJECTS

[75] Inventors: Helmut Jordan; Peter Buck; Rainer Anthonj, all of Offenburg, Germany

[73] Assignee: Premark FEG L.L.C., Wilmington, Del.

[21] Appl. No.: 648,920

[22] Filed: May 16, 1996

[30] Foreign Application Priority Data

May 18, 1995 [DE] Germany ..... 195 18 329.0

[51] Int. Cl.[6] ..... B07C 5/344

[52] U.S. Cl. ..... 209/567; 209/571; 209/598

[58] Field of Search ..... 209/571, 598, 209/567, 570

[56] References Cited

U.S. PATENT DOCUMENTS 3,394,804 7/1968 Reichel ..... 209/73
3,588,686 6/1971 Lingmann ..... 209/570 X

FOREIGN PATENT DOCUMENTS 0148139 7/1985 European Pat. Off. ..... 209/570
0581699 2/1994 European Pat. Off. .

*Primary Examiner*—David H. Bollinger
*Attorney, Agent, or Firm*—Thompson Hine & Flory LLP

[57] ABSTRACT

The invention is concerned with a method for identifying different, elongated metallic objects according to position and/or shape and/or type. In this method, by means of a conveyor, an object lying singly in a predetermined or a random position on conveyor is guided in terms of its conveyor direction evenly and at a constant speed over at least one inductive scanner, the induction voltage which varies temporally while object is passed over inductive scanner, is measured. The measurement signal detected in this manner over time is stored as an identification signal in an electronic data processor so as to produce an identification signal collection, and the signals generated by objects during operating passes are compared by the electronic data processor with identification signals stored in a data memory, and then evaluated, whereupon an electrical output signal which can be assigned to the respectively identified object position and/or shape and/or type and which can be used to control a storing apparatus is generated.

15 Claims, 3 Drawing Sheets

METHOD AND APPARATUS FOR IDENTIFYING DIFFERENT, ELONGATED METALLIC OBJECTS

The invention is concerned with a method for identifying different elongated metallic objects, particularly items of cutlery, according to position and/or shape and/or type, and an apparatus for performing this method.

Various methods are known for the identification of items of cutlery (knife, fork, spoon, small spoon etc.) as a preparation for a subsequent sorting operation.

The simplest known method is a mechanical identification method in which several superimposed metal sheets fitted with slots are used. The outline of the slots of an individual sheet is respectively adapted to that of a specific item of cutlery, e.g. the knife. Disordered, jumbled up cutlery is placed on to the upper-most perforated sheet and the sheets vibrated. The items of cutlery fall through the openings, corresponding to their respective outline, in the sheets and hence are both identified and sorted. However, this method is extremely noisy, slow and does not stop items of cutlery from falling into openings not intended for them, on account of which reliable identification is not ensured. Furthermore, it is only possible to use this method to identify cutlery of an individual type; as far as a different type of cutlery is concerned, it is necessary to use other, correspondingly shaped slotted sheets.

An apparatus for sorting items of cutlery is known from EP 05 81 699 A1; in this apparatus, the items of cutlery on a conveyor belt are fed to a detection area where they are identified according to type and position. Various regulating flaps actuated by an adjustment device are arranged in the conveyor section of this apparatus adjoining the detection area. Depending on the detector signal, a flap assigned to a specific type of cutlery, i.e. e.g. knife, spoon, fork, small spoon, and assigned to a specific position, is actuated so that the corresponding item of cutlery reaches a collecting compartment. Items of cutlery which cannot be assigned to any specific type or which are faulty ultimately reach a terminal container. The apparatus further comprises an identification device with several detectors or sensors which are spaced apart in the direction of the length and width above a flat base on which the items of cutlery are guided. The respective detectors comprise transmitters located in the flat base and receivers arranged above the base. When examined in cross section, the flat base is slightly inclined and together with a lateral guide, forms a V-type groove. The items of cutlery are consequently forced into a predetermined position and thus passed through the detection area. Depending on the type (knife, spoon, fork, small spoon) and position (i.e. top of the item of cutlery forwards or backwards) of the item of cutlery, the identification device's detectors supply signals in a specific sequence which form a signal sequence representing an identification signal. These signals are stored in a data processing device and during operating passes are then compared with the respective signals from the detectors, thereby identifying the items of cutlery. Due to the detectors' distributed spatial arrangement, the individual signals supplied by the detectors are not available simultaneously. This is necessary so as to determine a specific signal sequence. An identification signal is produced by combining the respective individual signals to form a typical signal sequence which is available if all of the detectors' individual signals have been received. An identification signal supplied by the identification device is characterized by the specific sequence of individual signals of the various detectors, although the shape and size of these individual signals is irrelevant to the intended identification purposes. It is merely observed whether an individual signal is present or not at a specific point of the signal sequence. An available identification signal in the form of an identification signal sequence therefore possesses a code characteristic. On account of the detectors' arrangement and due to the manner of signal generation, only a limited number of identification signal combinations can be made available by this apparatus.

Another apparatus for sorting elongated metallic objects, particularly items of cutlery, is known from U.S. Pat. No. 3,394,804. Items of cutlery are introduced into this apparatus via a central overhead opening, are dropped on to a cone and are distributed by this on to a disk-shaped vibrator and into the vibrator's radial ribs. In this manner, a separation of the items of cutlery is achieved. Due to the vibrator's vibration, the items of cutlery move to an opening located at the center of the vibrator and fall through this opening on to the central area of the turntable beneath it. The turntable's rotation causes the items of cutlery to shift outwards through sectorial passages formed by radially extending turntable walls, causing them to leave the passages and reach an annular channel arranged around the turntable. The items of cutlery pass, in a predetermined position, through an inductive detector device located in the channel and are identified. Depending on the particular type of cutlery, the inductive scanning apparatus is designed to provide a varyingly large d.c. voltage, by means of the characteristic value of which the item of cutlery is identified. Trapdoors adjoining the detection area are actuated in accordance with this signal, with the result that an identified item of cutlery can be supplied to a collecting container.

The invention is based on the technical problem of providing an effective and flexible method for the reliable and reproducible identification of elongated metallic objects, particularly items of cutlery, as well as an apparatus for performing this method.

To solve this object, the method according to the invention envisages using a conveyor device to guide objects lying singly and in a predetermined or a random position on this conveyor device; in terms of their conveyor direction, these objects are also intended to be guided evenly and at a constant speed over at least one inductive scanner. The induction voltage which temporally varies throughout the object's passage across the inductive scanner is measured and the measurement signal thus detected over time is stored as an identification signal in an electronic data processor. Signals generated by objects during operating passes are compared by means of the electronic data processor with identification signals stored in a data memory and analyzed. As a result, an electrical output signal which can be assigned to the respectively identified object position and/or shape and/or type and can be used to control a sorting apparatus is generated.

As far as the further description is concerned, it is assumed that the different, elongated metallic objects are items of cutlery.

While the metallic items of cutlery pass over the inductive scanner, for example a current-carrying and correspondingly wound coil, the item of cutlery, on account of its relative permeability which differs from the coil environment, locally increases or decreases the magnetic flux density and hence the magnetic flux in the scanner. The induced voltage can be tapped and measured at the scanner. Due to the particular shape and the mass distribution of an item of cutlery, the magnetic flux and hence the induced voltage, which is measured per unit of time, is a function of these parameters.

The induced voltage applied over time can be represented advantageously as a signal curve. A scanned item of cutlery therefore always generates a signal curve typical of its position, shape and hence type. The uniform supply of parts at a constant rate ensures the comparability of measurements. The separation of items of cutlery on the conveyor device prevents the individual measurement signals from overlapping.

When compiling a collection of identification signals, it is advantageous to measure in this manner on the conveyor device the signals of different types of cutlery in their various positions and to store them in a suitable electronic data processing device. In subsequent user-end operations of the apparatus for identifying items of cutlery, the currently generated signal of an item is compared by means of a suitable algorithm with the identification signals stored in the data processor's data memory. If a similarity or matching of the signal curves is established, the apparatus generates an electrical output signal representative for each identified position, shape and type of item of cutlery; this signal can be advantageously used to control a sorting apparatus.

The method according to the invention enables the reliable, continuous and reproducible identification of different, elongated metallic objects, such as items of cutlery. The method is however equally applicable to other metallic objects. The single items of cutlery to be identified may be present in a predetermined position or disordered and randomly positioned. The method permits a high signal generating and processing frequency. Unlike known computer-assisted identification methods, inductive scanning ensures a very short access and computing time of the electronic data processor used, making it possible to identify large quantities rapidly. The identification of different types of cutlery can be individually adapted to requirements and supplemented by means of stored collections of identification signals.

The apparatus according to the invention uses as a conveyor device in an advantageous manner an endlessly revolving conveyor belt or an adequate conveyor mechanism, since constant conveyor speeds and a uniform movement can thereby be effectively achieved.

The inductive scanner has an elongated shape and is arranged transversely in relation to the conveyor direction and expediently across its entire width, causing items on the conveyor device to be reliably detected by the scanner.

In an embodiment where the coil is elongated or horizontally annular or frame-shaped, the winding of the inductive scanner is advantageously designed such that in the case of a current-carrying coil, the magnetic flux lines penetrate the conveyor device perpendicular and at a right angle to the conveyor direction.

If the items of cutlery are guided with their longitudinal axis exactly parallel to the conveyor direction, a vertically annular or frame-shaped coil is also advantageously available as an inductive scanner, with the items of cutlery, parallel to the magnetic flux lines, being passed through the coil. As already mentioned above, either one or more inductive scanners can be used in the apparatus according to the invention.

Another advantageous embodiment of the apparatus envisages the elongated inductive scanner being arranged at an angle to the transport direction and across the entire width of the conveyor device. If two superimposed or consecutive scanners are used, they are positioned such that their longitudinal axes or the imaginary extensions of their longitudinal axes intersect. In the case of wide conveyor devices, items of cutlery may end up on this device in various positions relative to the device's direction of transport. An item of cutlery, which with its longitudinal axis is parallel to the inductive scanner's longitudinal axis, then passes over the scanner in a considerably shorter time than an item that moves transversely in relation to the scanner's longitudinal axis. A very narrow signal curve in terms of time results therefrom. Yet a certain temporal signal curve width is needed for better identification and comparability of the signal generated by an item of cutlery with those identification signals contained as a data store in an electronic data processing device and with the requisite computing times. The arrangement and design of the conveyor device and the inductive scanner must therefore always be chosen in such a way that during identification mode and whatever the position of the ends of the item of cutlery, the cutlery's longitudinal axis encounters the inductive scanner's longitudinal axis at an angle that is obtuse as far as possible. This is ensured in an advantageous manner by the inductive scanner's above simple angled arrangement.

In the case of conveyor devices where the items of cutlery are randomly positioned, the use of the intersected scanner configuration is recommended. If an item of cutlery passes over a scanner exactly parallel or at an acute angle, the second scanner is however in any case passed at an obtuse angle, from which a favorable temporal measurement signal width results.

An exemplary embodiment of the invention is described in the following with reference to the drawings.

Figure 1:
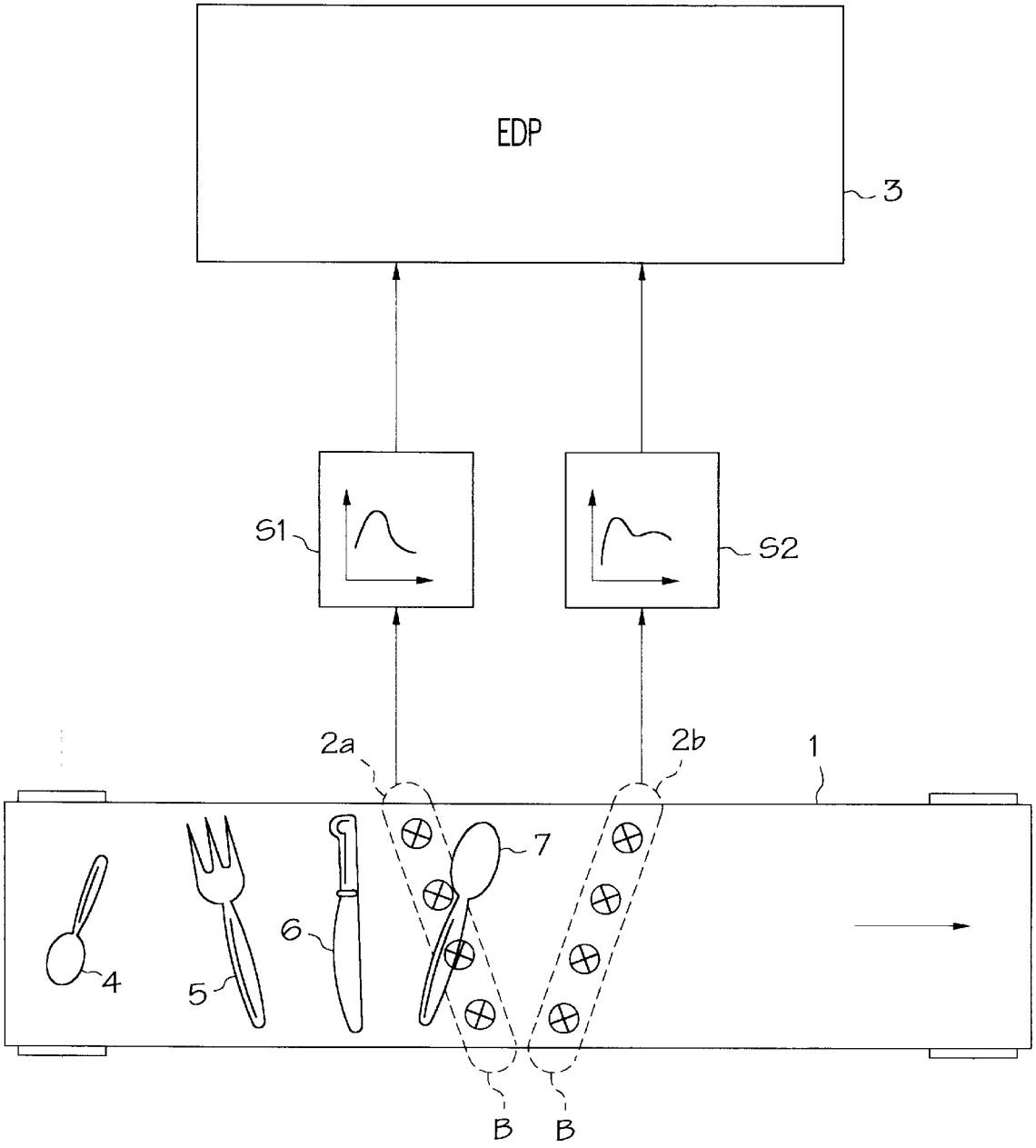
FIG. 1 shows a schematic representation of a method according to the invention for identifying items of cutlery and an apparatus for performing this method.

FIG. 1 shows a conveyor means 1 in the form of an endlessly revolving conveyor belt. The conveyor direction is marked by an arrow. Items of cutlery 4, 5, 6 and 7 located singly, i.e. not overlapping with their imaginary delineative rectangles formed by the conveyor belt sides and two parallel lines transverse to the conveyor direction, and randomly positioned on this conveyor means 1 are, in terms of their conveyor direction, guided uniformly and at a constant speed over two inductive scanning apparatuses 2*a*, 2*b*.

In the present example, the elongated inductive scanners 2*a*, 2*b* are arranged beneath conveyor means 1 and extend at an angle across its entire width. Depending on the embodiment of the scanners used, it is also conceivable to place them above the conveyor means or to design the scanners such that the conveyor means guides the objects to be conveyed through the scanners. Inductive scanners 2*a* and 2*b* are also positioned in relation to one another such that the imaginary extensions of their longitudinal axes intersect. The coil windings of inductive scanners 2*a*, 2*b* are designed such that in the case of a current-carrying coil, magnetic flux lines B penetrate conveyor means 1 perpendicular and at a right angle to the conveyor direction.

The temporally varying induction voltage induced by an item of cutlery 7 when passing over an inductive scanner 2*a* is tapped at the scanner and measurement signal S1 detected in this way over time is passed on to an electronic data processor 3.

Figure 2:
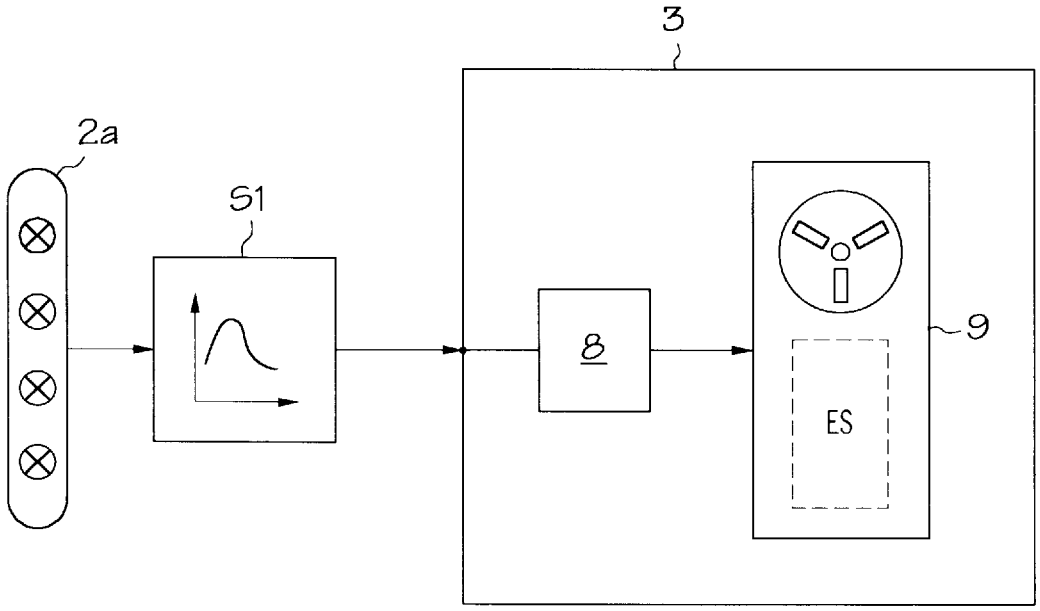
FIG. 2 shows a schematic block diagram of measurement-signal detection and storage.

As illustrated in FIG. 2, measurement signal S1 coming from inductive scanner 2*a* and which can be represented and interpreted as a signal curve is stored via a suitable interface 8 in a data memory 9 of electronic data processor 3. In this manner, the signals from a variety of items of cutlery of varying position, shape and type are combined into an identification signal collection ES necessary for the subsequent identification of items of cutlery at the user end.

Figure 3A:
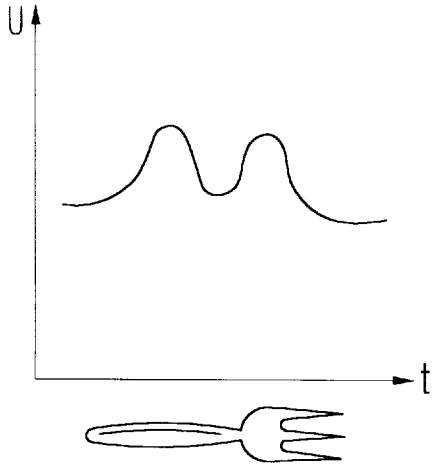
FIGS. 3A and 3B show a schematic representation of the signal curves of two different items of cutlery.
Figure 3B:
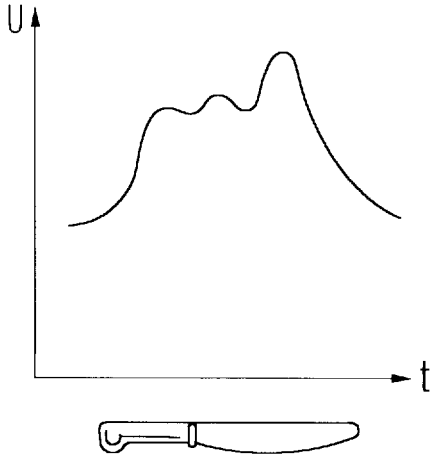

As shown in FIGS. 3A and 3B, a scanned item of cutlery constantly generates a signal curve typical of its position, shape and hence type; this signal curve can be applied and interpreted for identification purposes. In the Figures, U designates the induced voltage and t the time.

Figure 4:
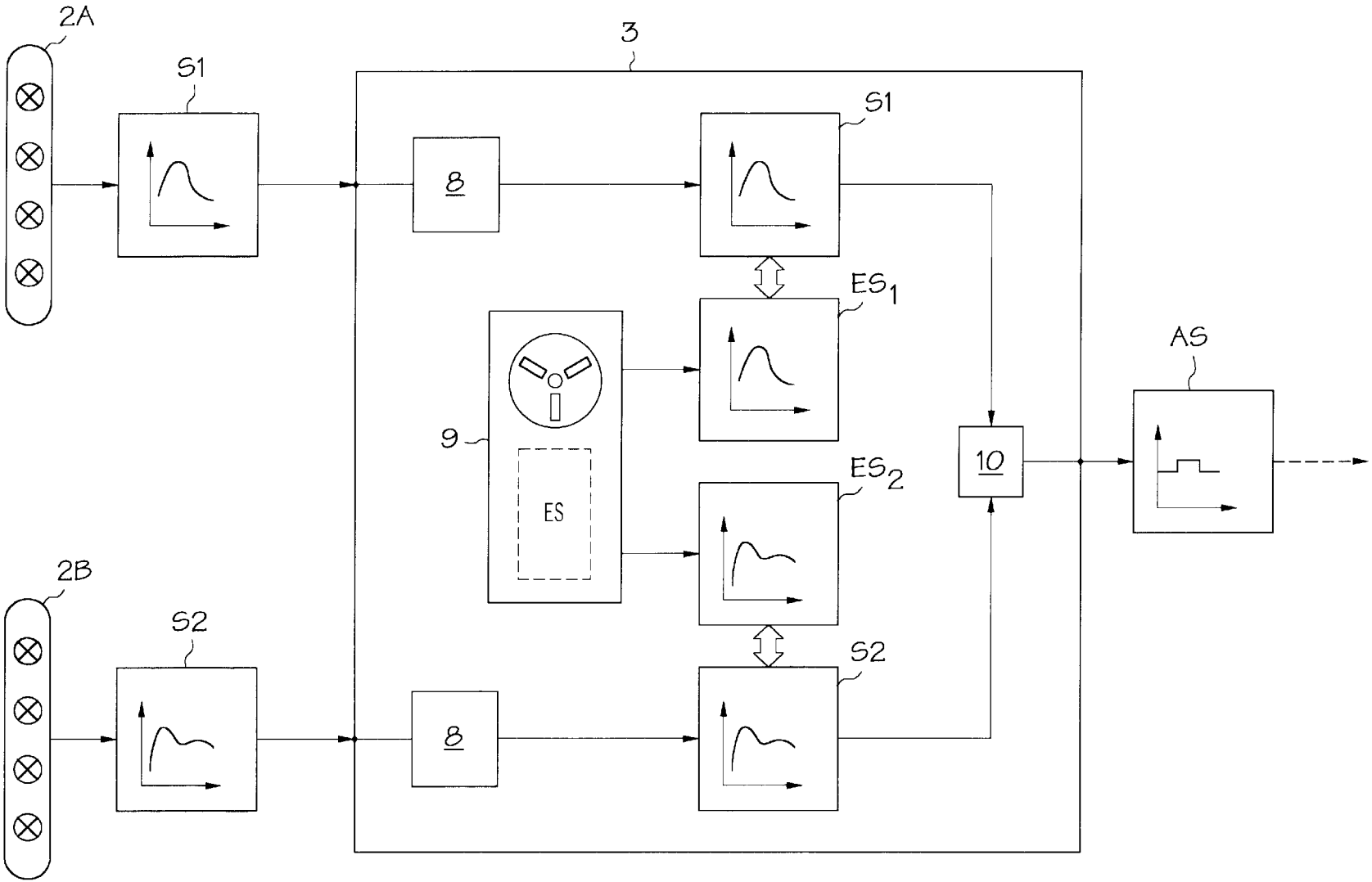
FIG. 4 shows a schematic block diagram of the method for identifying items of cutlery in user mode.

As explained in FIG. 4, a measurement signal S1 coming from inductive scanner 2*a* is compared via a suitable program algorithm with those signals obtained from identification signal collection ES and stored in data memory 9 of electronic data processor 3. If a concurrence or sufficient similarity is established, the item of cutlery is unequivocally identified by the identification signal representing a specific position, shape and hence type. In this instance, an output signal AS is outputted via an additional interface 10 in electronic data processor 3 in order to control a sorting apparatus for items of cutlery. The sorting apparatus is not shown in the drawings.

If the measurement signal S1 cannot be evaluated, which is primarily due to a measurement time that is too short on account of the parallel position of the item of cutlery in relation to the longitudinal axis of inductive scanner 2*a*, there is provision for arranging a second inductive scanner 2*b*, as shown in FIG. 1, in the conveyor direction behind the first scanner 2*a*, with the imaginary extensions of the longitudinal axes of both scanners 2*a*, 2*b* intersecting. This ensures that an item of cutlery which cannot be evaluated in the above sense always passes over the second scanner 2*b* at an obtuse angle, from which a favorable temporal measurement signal width results.

If it is not possible to use measurement signal S1, measurement signal S2 of scanner 2*b* is therefore applied and is compared, in the manner already described at the beginning, with the signals of the identification signal collection ES. If identification is successful—concurrence can be established by an identification signal $ES_2$—an output signal AS acting as a control signal for a subsequent sorting apparatus is in turn outputted via the additional interface 10.

In general, the invention's method for identifying different, elongated metallic objects and the apparatus for performing this method can also be realized by using inductive scanners or sensors other than those mentioned. Capacitive or optical sensors or those based on other physical principles are just as feasible in order to generate measurement and identification signals and then to evaluate them in the special manner according to the invention. Unlike the preferred inductive scanners, the necessary computational input is very high however. Correspondingly efficient electronic data processors and program algorithms can however also be used to obtain this result in the sense of the invention.

We claim:

1. A method for identifying different, elongated metallic objects according to positon, shape, type, or any combination thereof, comprising the steps of:

guiding by means of a conveyor, an object (7) lying singly in a predetermined or a random position on said conveyor in terms of a conveyor direction evenly and at a constant speed;

measuring over at least one inductive scanning apparatus (2*a*), an induction voltage which varies temporally while said object (7) is passed over said inductive scanner storing measurement signal (S1)) which is detected over time as an identification signal in an electronic data processor (3);

comparing signals (S1, S2) generated by objects (4, 5, 6, 7) during operating passes by means of said electronic data processor (3) with identification signals ($ES_1$, $ES_2$) stored in a data memory (9), and then evaluating said signals (S1, S2); and generating an electrical output signal (AS) which can be assigned to the respectively identified object position, shape, or type and which can be used to control a sorting apparatus.

2. A method according to claim 1 further comprising the steps of:

compiling an identification signal collection (ES), for individual objects (4, 5, 6 7) of varying position, shape and type;

guiding by said conveyor over said inductive scanner (2*a*); and storing the resultant measurement signals (S1) typical of the respective position, shape and type in said electronic data processor (3).

3. The method of claim 2 wherein several inductive scanners are simultaneously used for signal generation.

4. A method according to claim 1, wherein several inductive scanners (2*a*, 2*b*) are simultaneously used for signal generation.

5. An apparatus for identifying different, elongated metallic objects according to position, shape type or any combination thereof, comprising at least one inductive scanner (2*a*, 2*b*) for measuring a temporally varying induction voltage and for generating measurement signals (S1, S2) detected therefrom;

a conveyor for conveying elongated metallic objects, wherein in terms of the conveyor direction, said conveyor moves said objects evenly and at a constant speed relative to inductive scanner (2*a*, 2*b*); and an electronic data processor (3) for storing, comparing and evaluating said measurement signals (S1, S2), used as identification signals (ES1, ES2), of said inductive scanner (2*a*, 2*b*), said electronic data processor (3) generating an output signal (AS) which can be used to control a sorting apparatus for said objects.

6. An apparatus according to claim 5, wherein said conveyor is an endlessly revolving conveyor belt.

7. An apparatus according to claim 5, wherein said inductive scanner (2*a*) is arranged below or above said conveyor and extends across the entire width of said conveyor.

8. An apparatus according to claim 5, wherein said inductive scanner (2*a*) is arranged at an angle to the conveyor direction.

9. An apparatus according to claim 5, wherein two or more inductive scanners (2*a*, 2*b*) are arranged at an angle to the conveyor direction and their longitudinal axes or their imaginary extensions are arranged so as to intersect.

10. The apparatus of claim 9 wherein a coil of said inductive scanner is wound and arranged in relation to said conveyor means such that, in the case of current-carrying coil, the magnetic flux lines (B) penetrate said conveyor means perpendicular and at right angles to the conveyor direction.

11. The apparatus of claim 9 wherein said objects are passed by said conveyor through said coil parallel to said magnetic flux lines.

12. An apparatus according to claim 5, wherein a coil of said inductive scanner (2*a*) is wound and arranged in relation to said conveyor means (1) such that, in the case of a current-carrying coil, the magnetic flux lines (B) penetrate said conveyor means (1) perpendicular and at a right angle to the conveyor direction.

13. An apparatus according to claim 5, wherein said objects (4, 5, 6, 7) are passed, by means of said conveyor, through said coil parallel to said magnetic flux lines.

14. The apparatus of claim 5 wherein said inductive scanner is arranged below or above said conveyor means and extends across the entire width of said conveyor means.

15. The apparatus of claim 5 wherein said inductive scanner is arranged at an angle to the conveyor direction.

* * * * *